US005319377A

United States Patent [19]

Thomas et al.

[11] Patent Number: 5,319,377

[45] Date of Patent: Jun. 7, 1994

[54] WIDEBAND ARRAYABLE PLANAR RADIATOR

[75] Inventors: Mike Thomas, Thousand Oaks; Ronald I. Wolfson, Los Angeles, both of Calif.

[73] Assignee: Hughes Aircraft Company, Los Angeles, Calif.

[21] Appl. No.: 864,709

[22] Filed: Apr. 7, 1992

[51] Int. Cl.[5] ..... H01Q 1/38

[52] U.S. Cl. ..... 343/700 MS; 343/770; 343/795

[58] Field of Search ..... 343/767, 700 MS, 795, 343/770; H01Q 13/10, 1/38

[56] References Cited

U.S. PATENT DOCUMENTS

| | | | |
|---|---|---|---|
| 4,500,887 | 2/1985 | Nester | 343/795 |
| 4,758,843 | 7/1988 | Agrawal et al. | 343/795 |
| 4,843,403 | 6/1989 | Lalezari et al. | 343/700 MS |

*Primary Examiner*—Donald Hajec

*Assistant Examiner*—Tan Ho

*Attorney, Agent, or Firm*—L. A. Alkov; W. K. Denson-Low

[57] ABSTRACT

This invention discloses an antenna element (12) or an array of antenna elements (52) for use in multifunctional systems which exhibits wide bandwidth, small size, polarization diversity and conformality. In one preferred embodiment, an array of circular conductive patches (56,58) are formed on a dielectric substrate (54) in which adjacent patches are formed on opposite sides of the substrate (54). Each of the opposite conducting patches (56,58) are configured to form a dual flared slotline such that an electric field created between the two conductive patches (56,58) will exhibit a wide range of impedance matching to free space. By exciting the conductive patches (56,58), radiating electromagnetic waves having a polarization with respect to the orientation of the slotlines is produced. By this, a single array of antenna elements (52) can be used in a multifunctional system.

16 Claims, 2 Drawing Sheets

WIDEBAND ARRAYABLE PLANAR RADIATOR

BACKGROUND OF THE INVENTION

1. Technical Field

The present invention relates generally to an antenna radiating device, and more particularly, to a dual flared slotline antenna radiating device incorporating a wide bandwidth in an arrayable configuration.

2. Discussion

Antenna radiating devices, particularly driven at microwave frequencies, are required in certain systems such as radar and electronic warfare systems. Due to a variety of obvious as well as complicated factors, it is highly desirable to provide all of these radar and electronic warfare functions on a single, low-profile system. Because of this, many constraints on an antenna radiating device incorporated in the low-profile system, such as wide bandwidth, small size, polarization diversity and conformality, are required in order to realize a system which meets all of the requirements of each different function. Furthermore, it is necessary that low radar cross section characteristics are also maintained. The success of such systems have heretofore been limited in attempting to develop a low-profile system which adequately meets all these characteristics at a high level of effectiveness.

Presently, the most commonly used antenna element in these multifunctional systems is the so-called cross flared notch antenna, known in the art. See for example, Povinelli, *Desion and Performance of Wideband Dual Polarized Stripline Notch Arrays*, 1988 IEEE AP-S International Symposium, Volume I, "Antennas and Propagation," June 6–10, 1988. However, cross flared, notched antennas have the disadvantage of ineffective conformality. In other words, the depth dimension of the antenna is significant enough to severely limit its ability to conform to desirable structures. Further, reducing the depth dimension of the antenna will result in limiting the impedance match to free space at the low frequency end of the operating band.

A second design attempting to satisfy the characteristics of the above-described functions is the dual flared slotline antenna. See for example, Povinelli, *Further Characterization of a Wideband Dual Polarized Microstrip Flared Slot Antenna*, 1988 IEEE AP-5 International Symposium Volume II, "Antennas and Propagation," June 6–10, 1988. Although the dual flared slotline antenna is low-profile and arrayable, its impedance bandwidth is limited by its conventional transition to slotline. In addition, it does not satisfy many size constraints and has four feed points per antenna element which necessitates the use of two driver networks.

What is needed then is an arrayable antenna which includes the characteristics of wide bandwidth, small size, polarization diversity and conformality in order to provide the necessary requirements for multifunctional systems, and further, has a reduction in the number of feed points per antenna element required over the prior art systems. It is therefore an objective of the present invention to provide such an antenna.

SUMMARY OF THE INVENTION

Disclosed is an antenna incorporating a radiating element having a number of desirable characteristics including a wide bandwidth, small size, polarization diversity and conformality. The radiating element is configured in a dual flared, slotline configuration in which specially shaped conducting patches form the flared slotlines and are excited from a common feedpoint. The flaring of the slotlines in the radiating element allows a smooth impedance transmission between an input line and the slotline, as well as a wide input impedance match between the slotline and free space. In one preferred embodiment, the input line is a single coaxial input line connected to each conductive patch of the radiating element proximate the center of the flared region. In this manner an outer conductor of the coaxial input line is connected to one of the conducting patches and an inner conductor of the coaxial input line is connected to the other conducting patch. Other feed lines, such as microstrips, slotlines, coplanar waveguides, and two- or three-wire transmission lines are also applicable. A signal on the input line creates an electric field across the slotline which generates an electromagnetic wave polarized in a direction substantially perpendicular to the slotline.

A plurality of preshaped conductive patches can be combined on a common substrate to form an antenna array incorporating a design which would be more functionally practicable. In an arrayed configuration, adjacent conductive patches forming each flared slotline will be fed by a common feedline producing polarization in a direction perpendicular to the axis of the slotline. In addition, by incorporating conductive patches in prearranged rows and columns, it is possible to generate an electromagnetic wave which is polarized in more than one direction.

Additional objects, advantages and features of the present invention will become apparent from reading the following description and appended claims taken in conjunction with the accompanying drawings.

BRIEF DESCRIPTION OF THE DRAWINGS

FIG. 1(*b*) is a side view of the antenna radiating element of FIG. 1(*a*);

DETAILED DESCRIPTION OF THE PREFERRED EMBODIMENT

The following description of the preferred embodiments concerning antennas and antenna arrays is merely exemplary in nature and is in no way intended to limit the invention or its application or uses.

Figure 1A:
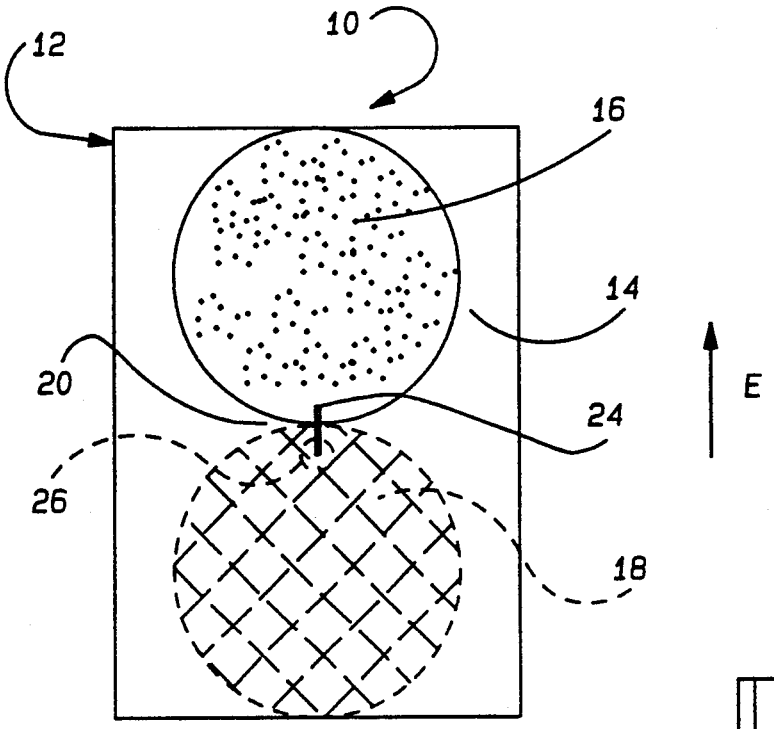
FIG. 1(*a*) is a top view of a dual flared slotline antenna radiating element according to one preferred embodiment of the present invention.
Figure 1B:
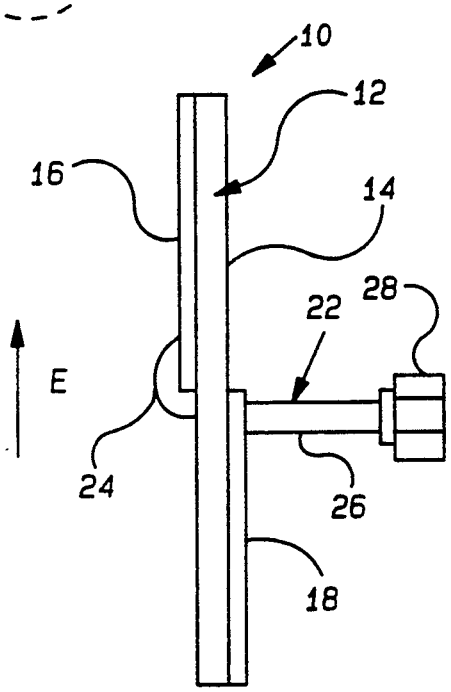

First turning to FIG. 1, an antenna radiating system 10 is shown in a top view in FIG. 1(*a*) and a side view in FIG. 1(*b*). Radiating system 10 includes an antenna element 12 for generating electromagnetic waves, generally at a microwave frequency. Antenna element 12 includes a dielectric substrate 14, an upper conducting patch 16 and a lower conducting patch 18. As is apparent from the figures, upper conductive patch 16 is generally circular in nature and is formed on a top portion of one side of dielectric substrate 14. Conducting patch 18 is also generally circular in nature and is formed at a lower portion of dielectric substrate 14 on an opposite side from conductive patch 16. The conducting patches 16 and are an appropriate conductive material, such as copper, and are adhered or printed to dielectric substrate 14 by an applicable method such as vapor deposition or a rolling process as are known in the art. The shapes of conducting patches 16 and 18 can be formed by an etching process as is also known in the art.

In this embodiment, the generally circular conducting patches 16 and 18 are tangential to each other with respect to the top view. However, by viewing the side view of FIG. 1(*b*) it is apparent that the spacing between the bottom portion of conductive patch 16 and the upper portion of conductive patch 18 forms a slotline portion through the dielectric substrate 14. Furthermore, the arcuate shape of both conducting patches 16 and 18 form a dual flared region at the slotline location generally depicted by reference numeral 20. Consequently, there are two regions which flare inwards towards the center of the slotline to form the dual flared slotline.

Conducting patches 16 and 18 are excited by a coaxial feedline 22. Coaxial feedline 22 includes an inner conductor 24 and an outer conductor 26, and a connecting device 28 to connect coaxial feedline 22 to an appropriate driving device (not shown). Inner conductor 24 transverses and is insulated from the lower conducting patch 18, and is electrically connected to the upper conducting patch 16, as shown. Outer conductor 26 is electrically connected to the lower conducting patch 18, as shown. Consequently, a single feedline 22 excites the conductive patches 16 and 18 of antenna element 12. In this manner, an appropriate, alternating excitation signal at a desirable frequency applied to coaxial feedline 22 excites the conducting patches 16 and 18, which in turn produces an electric field across the slotline region 20 separating the two conducting patches 16 and 18. Because the slotline region 20 is flared, the electric field will be shaped and have different electric field strengths and resistances according to the distance between the conductive patches 16 and 18. Also, other inputs, such as microstrips, slotlines, coplanar waveguides, and two- or three-wire transmission lines known to those skilled in the art, would also be applicable.

The electric field across the slotline generates radiating electromagnetic waves at a frequency set by the parameters of the frequency of the input signal, the dimension of the slotline and the size, shape and material of the conducting patches 16 and 18. The majority of the generated waves propagate perpendicular to the plane of the antenna element 12. The axis along the length of the slotline determines at what orientation the electric field will be relative to the propagation of the waves. For the orientation of the slotline defined by conducting patches 16 and 18 of the embodiment of FIG. 1, the electric field of the propagating waves will be oriented as shown, perpendicular to the slotline in the plane of the paper.

Figure 2:
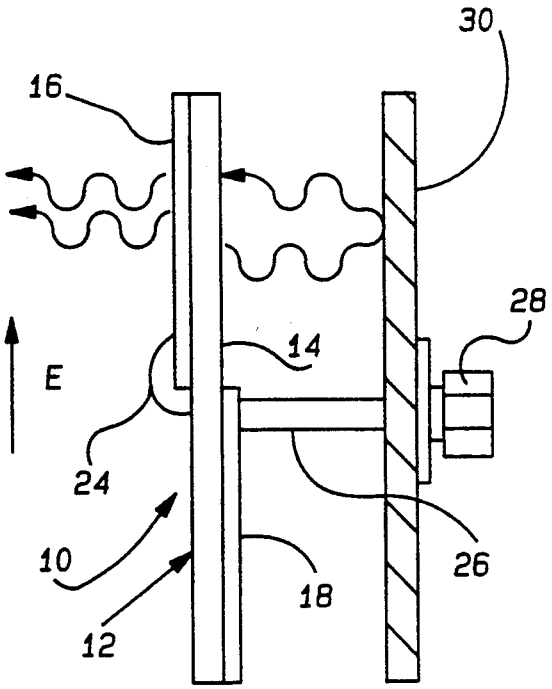
FIG. 2 is a side view of the antenna radiating element of FIG. 1(*b*) incorporating a reflective groundplane.

Because the generated electromagnetic waves propagate substantially perpendicular to the plane of the antenna element 12, it is generally desirable to provide a groundplane which reflects the portion of the electromagnetic waves traveling in one direction in order to reverse its propagation direction, and thus enable substantially all of the power output of the antenna radiating system 10 to be in one direction. This concept is shown in FIG. 2, where a groundplane 30, shown in cross section, is positioned relative to antenna element 12 by appropriate means. The distance between the surface of dielectric substrate 14 and the surface of groundplane 30 is selected to be a quarter-wavelength derivative of the frequency of the generated waves in order to reflect the waves in phase with the waves propagating from the other side of the antenna system 10, as shown. Consequently, the majority of the electromagnetic intensity produced is channeled in a single direction.

The antenna radiating system 10 discussed above gives a number of desirable characteristics for use in a multifunctional, low-profile radiating system which includes wide bandwidth, small size, polarization diversity and conformality. In addition, in certain radar applications, system 10 should also have low radar cross section (RCS) characteristics in that it reduces the probability that the system will be detected by radar.

Of all of the desirable characteristics mentioned above, the most important feature for most applications would probably be in that system 10 exhibits excellent impedance matching to the input signal and a wide impedance bandwidth to free space. This characteristic is provided by the flared slotline being fed by a single feeding device at the center of the slotline where the slotline is the narrowest. This narrowest dimension of the slotline is selected to provide the desirable impedance matching between the input line and the slotline. In addition, the variable distance between the two conducting patches 16 and 18 provided by the flared slotline gives a wide range of impedances which enable the electric field created across the slotline to be matched to the impedance of free space.

The relatively small size of the different conducting elements and the thickness of the antenna element 12 itself enables the radiating system 10 to be easily implemented in many different multifunctional systems, and to be shaped to different structures, such as curved surfaces. In one example, each of the conducting patches 16 and 18 has a diameter of approximately 0.325". The dielectric substrate 14 is positioned at approximately 0.25" from groundplane 30. Since the groundplane 30, substrate 14 and conducting patches 16 and 18 are relatively very thin, the total thickness of the antenna element 12 is also approximately 0.25", thus providing a flexible structure to be shaped as desired. A system with this dimension performed well over 5–18 GHz with good voltage standing wave ratio (VSWR) and radiation patterns.

Figure 3:
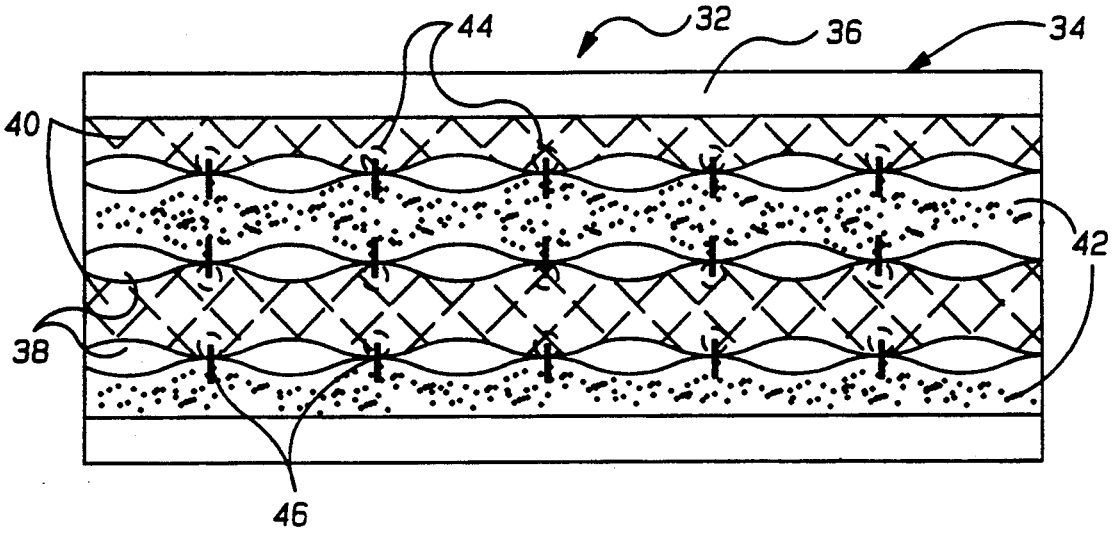
FIG. 3 is an array of dual flared slotline radiating elements according to another preferred embodiment of the present invention.

The system as described above has its greatest application in an arrayed configuration of antenna elements. Now turning to FIG. 3, a top view of a radiating system 32 including an array of antenna elements 34 is shown in a specialized configuration to demonstrate the multifunctional capabilities. The array of antenna elements 34 are depicted in which preshaped metalized patches on one side of a dielectric substrate and preshaped metalized patches on the other side of the dielectric substrate form a plurality of consecutive dual flared slotlines. More particularly, first preshaped conductive patches 40 on one side of a dielectric substrate 36 are aligned with second preshaped conductive patches 42 on an opposite side of the dielectric substrate 36 to form a series of dual flared slotlines represented by regions 38. As is apparent, the edges of each conductive patch 40 and 42 which are adjacent on the opposite sides of the dielectric substrate 36, are shaped in a wave-like fashion to form the slotline regions 38. In this embodiment, each of the conductive patches 40 and 42 are connected to a coaxial feedline comprising an outer conductor 44 and an inner conductor 46 proximate the narrowest region of each slotline 38, as shown. As above, each of the inner conductors 46 are connected to conductive patches 42 and each of the outer conductors are connected to conductive patches 40. Each of the coaxial feedlines are driven separately at a common frequency and selected phase to produce electromagnetic waves radiating from system 32 with a coherent phase front. In array system 32, the polarization is again aligned along the orientation of the slotlines 38 such that the electromagnetic wave is polarized in the direction perpendicular to the slotlines 38.

Figure 4:
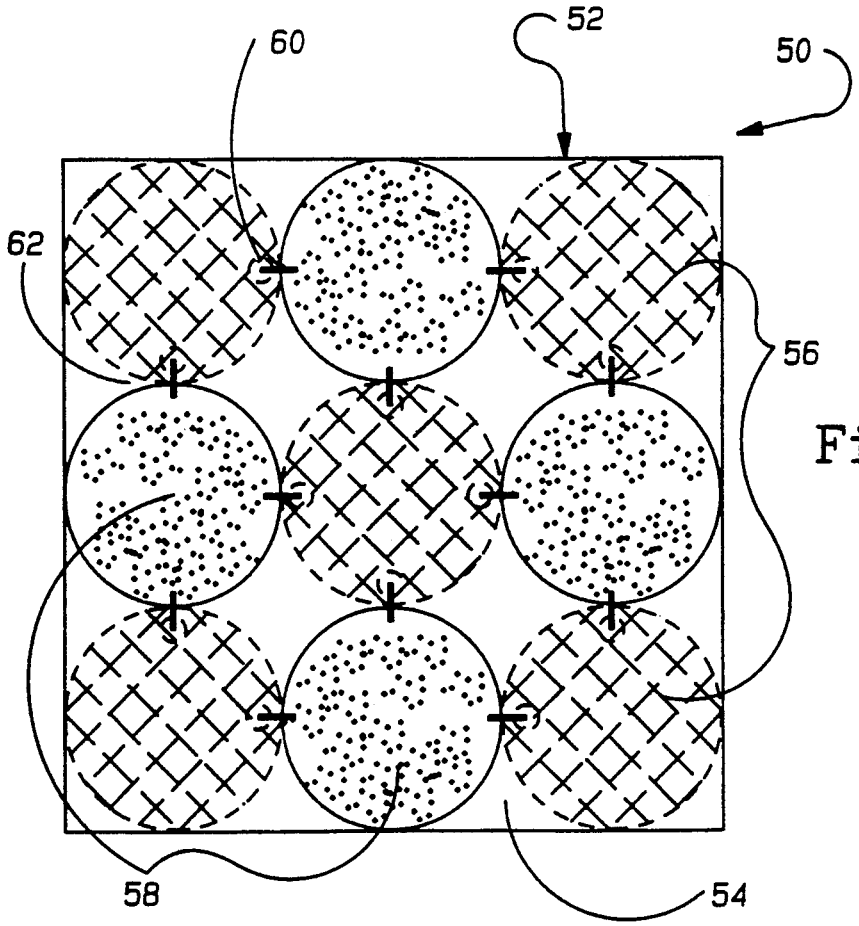
FIG. 4 is an array of dual flared slotline radiators according to yet another preferred embodiment of the present invention.

Now turning to FIG. 4, a radiating system 50 incorporating a second array of antenna elements 52 is shown. In this embodiment, the shapes of the different conductive patches are more akin to those of the conductive patches 16 and 18 of FIG. 1. More particularly, the array of antenna elements 52 includes three rows and three columns of substantially circular conductive patches in an alternating configuration where conductive patches 56 on one side of a dielectric substrate 54 alternate with conductive patches 58 on the opposite side of dielectric substrate 54, as shown. In other words, a conductive patch on one side of the substrate 54 will be adjacent to conductive patches on the opposite side of substrate 54. Consequently, two columns and rows of three commonly polarized dual flared slotlines are formed, one of which is depicted by reference numeral 62. By incorporating coaxial feeding devices 60 at each slotline location, as with FIG. 1, it is possible to produce a source of electromagnetic radiation which is polarized in two orthogonal directions. More particularly, the slotlines which are aligned in the rows will have a polarization in one direction and the slotlines which are aligned in the columns will have a polarization in a direction perpendicular to the polarization of the other direction. Consequently, polarization diversity can be achieved for a wide variety of applications.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined by the following claims.

We claim:

1. An antenna radiating device comprising:

a dielectric substrate having a first side and a second side;

a first conductive patch position on the first side of the dielectric substrate;

a second conductive patch positioned on the second side of the dielectric substrate, wherein the first and second conductive patches are positioned relative to each other such that the shaped of the first and second conductive patches are substantially circular and form a dual flared slotline antenna element and wherein the first and second conductive patches are substantially tangential to each other as viewed form a direction perpendicular to the plane of the substrate; and feeder means for providing a signal to both the first and second conductive patches, connected to the conductive patches at a region where the slotline is the narrowest, wherein the signal generates an electric field across the slotline which drives the conductive patches to radiate an electromagnetic signal into free space.

2. The antenna radiating device according to claim 1 wherein the feeder means is a coaxial feedline having an inner conductor and an outer conductor, said inner conductor electrically connected to the first conductive patch and said outer conductor electrically connected to the second conductive patch.

3. The antenna radiating device according to claim 1 wherein the feeder means is selected from the group consisting of a microstrip, a slotline, a coplanar waveguide, and two- or three-wire transmission line.

4. The antenna radiating device according to claim 1 further comprising other conductive patches, wherein all of the conductive patches are arranged in a predetermined configuration to form an array of dual flared slotline antenna elements.

5. The antenna radiating device according to claim 4 wherein the feeder means is a plurality of feeders electrically connected to the conductive patches at a region where the slotlines are the narrowest.

6. The antenna radiating device according to claim 4 wherein the feeder means is a plurality of feeders electrically connected to the conductive patches.

7. The antenna radiating device according to claim 4 wherein the dual flared slotline antenna elements include slotline antenna elements in which the slotlines are configured in substantially perpendicular rows and columns to produce electromagnetic waves being polarized in two substantially orthogonal directions.

8. The antenna radiating device according to claim 1 further comprising a reflecting groundplane, said reflecting groundplane positioned relative to the antenna element such that a portion of the electromagnetic signal emitted from the antenna element is reflected off of the reflecting groundplane into a transmission direction.

9. A method of generating an electromagnetic signal comprising the steps of:

disposing a first conductive patch on a first side of a dielectric substrate;

shaping the first and second conductive patch into substantially circular shapes;

disposing the second conductive patch on a second side of the dielectric substrate, wherein the first and second conductive patches are positioned relative to each other such that the shaped of the first and second conductive patches form a dual flared slotline antenna element and wherein the first and second conductive patches are substantially tangential to each other as viewed from a direction perpendicular to the plane of the substrate; and electrically connecting a signal feeding device to both the first and second conductive patches at a region where the slotline is the narrowest in order to produce the electromagnetic signal.

10. The method according to claim 9 wherein the step of electrically connecting a feeding device includes the step of a electrically connecting a coaxial feeding device such that an inner conductor of the coaxial feeding device is connected to the first conductive patch and an outer conductor of the coaxial feeding device is connected to the second conductive patch.

11. The method according to claim 9 wherein the step of electrically connecting a feeding device includes the step of electrically connecting a feeding device selected form the group consisting of a microstrip, a co-planar waveguide, a slotline, and two- or three-wire transmission line.

12. The method according to claim 9 further comprising the step of disposing other conductive patches on the dielectric substrate to form an array of dual flared slotline antenna elements.

13. The method according to claim 12 wherein the step of electrically connecting a feeding device includes electrically connecting a feeding device to each slotline at a region where each slotline is narrowest.

14. The method according to claim 12 wherein the step of electrically connecting a feeding device includes electrically connecting a feeding device to each antenna element.

15. The method according to claim 12 wherein the step of forming an array of dual flared slotline antenna elements includes the step of forming substantially perpendicular rows and columns of slotlines to generate electromagnetic waves having dual polarity.

16. The method according to claim 9 further comprising the step of positioning a reflective groundplane relative to the dielectric substrate to reflect a portion of the electromagnetic signal into a transmission direction.

* * * * *